US008602111B2

(12) United States Patent
Vachon

(10) Patent No.: US 8,602,111 B2
(45) Date of Patent: Dec. 10, 2013

(54) METHOD AND SYSTEM FOR CONTROLLING A DOWNHOLE FLOW CONTROL DEVICE

(75) Inventor: Guy P. Vachon, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/352,668

(22) Filed: Feb. 13, 2006

(65) Prior Publication Data

US 2007/0187091 A1 Aug. 16, 2007

(51) Int. Cl.
*E21B 34/16* (2006.01)

(52) U.S. Cl.
USPC ..... 166/374; 166/375; 166/319; 166/386

(58) Field of Classification Search
USPC ..... 166/319, 321, 72, 374, 386, 375
See application file for complete search history.

(56) References Cited

U.S. PATENT DOCUMENTS

| | | | | |
|---|---|---|---|---|
| 4,651,969 | A | 3/1987 | Dowdall | |
| 4,771,807 | A | 9/1988 | Karani | |
| 4,915,168 | A * | 4/1990 | Upchurch | 166/250.15 |
| 6,179,052 | B1 | 1/2001 | Purkis et al. | |
| 6,276,458 | B1 | 8/2001 | Malone et al. | |
| 6,470,970 | B1 | 10/2002 | Purkis et al. | |
| 6,575,237 | B2 | 6/2003 | Purkis et al. | |
| 6,736,213 | B2 | 5/2004 | Bussear et al. | |
| 7,337,850 | B2 * | 3/2008 | Contant | 166/375 |
| 2002/0053438 | A1 | 5/2002 | Williamson, Jr. | |
| 2003/0127232 | A1 | 7/2003 | Bussear et al. | |
| 2003/0132006 | A1 | 7/2003 | Bussear et al. | |
| 2006/0278399 | A1 * | 12/2006 | Dwivedi et al. | 166/375 |

FOREIGN PATENT DOCUMENTS

| | | |
|---|---|---|
| GB | 2081777 | 7/1981 |
| WO | WO9961746 | 12/1999 |
| WO | WO0190532 | 11/2001 |
| WO | WO2006090168 | 8/2006 |

* cited by examiner

*Primary Examiner* — Sean Andrish
(74) *Attorney, Agent, or Firm* — Mossman, Kumar & Tyler PC

(57) ABSTRACT

A system for controlling flow in a wellbore uses a downhole flow control device positioned at a downhole location in the wellbore. The flow control device has a movable element for controlling a downhole fluid flow. In response to an applied pressure pulse, the movable element moves in finite increments from one position to another. In one embodiment, a hydraulic source generates a transmitted pressure pulse to the flow control device wherein the maximum pressure of a received pressure pulse downhole is sufficient to overcome a static friction force associated with the movable element, and wherein a minimum pressure of the received pressure pulse downhole is insufficient to overcome a dynamic friction force associated with the movable element.

18 Claims, 2 Drawing Sheets

METHOD AND SYSTEM FOR CONTROLLING A DOWNHOLE FLOW CONTROL DEVICE

CROSS-REFERENCE TO RELATED APPLICATION

None

BACKGROUND OF THE INVENTION

1. Field of the Invention

This invention relates generally to the control of oil and gas production wells. More particularly, it relates to control of movable elements in well production flow control devices.

2. Description of the Related Art

The control of oil and gas production wells constitutes an on-going concern of the petroleum industry due, in part, to the enormous monetary expense involved in addition to the risks associated with environmental and safety issues. Production well control has become particularly important and more complex in view of the industry wide recognition that wells having multiple branches (i.e., multilateral wells) will be increasingly important and commonplace. Such multilateral wells include discrete production zones which produce fluid in either common or discrete production tubing. In either case, there is a need for controlling zone production, isolating specific zones and otherwise monitoring each zone in a particular well. Flow control devices such as sliding sleeve valves, downhole safety valves, and downhole chokes are commonly used to control flow between the production tubing and the casing annulus. Such devices are used for zonal isolation, selective production, flow shut-off, commingling production, and transient testing.

It is desirable to operate the downhole flow control device with a variable flow control device. The variable control allows the valve to function in a choking mode which is desirable when attempting to commingle multiple producing zones that operate at different reservoir pressures. This choking prevents crossflow, via the wellbore, between downhole producing zones.

In the case of a hydraulically powered flow control device such as a sliding sleeve valve, the valve experiences several changes over time. For example, hydraulic fluid ages and exhibits reduced lubricity with exposure to high temperature. Scale and other deposits will occur in the interior of the valve. In addition, seals will degrade and wear with time. For a valve to act effectively as a choke, it needs a reasonably fine level of controllability. One difficulty in the accurate positioning of the moveable element in the flow control device is caused by fluid storage capacity of the hydraulic lines. Another difficulty arises from the fact that the pressure needed to initiate motion of the moveable element is different from the pressure needed to sustain motion, which is caused by the difference between static and dynamic friction coefficients, with the static coefficient being larger than the dynamic coefficient. When pressure is continuously applied through the hydraulic line, the elastic nature of the lines allows some expansion that, in effect, causes the line to act as a fluid accumulator. The longer the line the larger this effect. In operation, the combinations of these effects can cause substantial overshoot in the positioning of the moveable element. For example, if the hydraulic line pressure is raised to overcome the static friction, the sleeve starts to move. A known amount of fluid is commonly pumped into the system to move the element a known distance. However, because of the fluid storage effect of the hydraulic line and the lower force required to continue motion, the element continues to move past the desired position. This can result in undesirable flow restrictions.

The present invention overcomes the foregoing disadvantages of the prior art by providing a system and method for overcoming the static friction while substantially reducing the overshoot effect. Still other advantages over the prior art will be apparent to one skilled in the art.

SUMMARY OF THE INVENTION

In one aspect, the present invention provides a system for controlling a downhole flow control device that includes a flow control device at a downhole location in a well wherein the flow control device has a movable element for controlling a downhole formation flow. The movable element has a hydraulic seal associated therewith. The seal is constructed such that a maximum pressure of an applied pressure pulse is sufficient to overcome a static friction force associated with the seal, and wherein a minimum pressure of an applied pressure pulse is insufficient to overcome a dynamic friction force associated with the seal.

In another aspect, a method for controlling a flow control device includes transmitting a pressure pulse from a surface located hydraulic source to the flow control device at a downhole location. A characteristic of the pressure pulse is controlled to incrementally move a moveable element in the flow control device to a desired position. Exemplary controlled characteristic of the pressure pulse comprises pulse magnitude and pulse duration.

While the foregoing disclosure is directed to the preferred embodiments of the invention, various modifications will be apparent to those skilled in the art. It is intended that all variations within the scope of the appended claims be embraced disclosure. It will be apparent, however, to one skilled in the art that many modifications and changes to the embodiment set for the above are possible without departing from the scope and the spirit of the invention. It is intended that the following claims be interpreted to embrace all such modifications and changes.

BRIEF DESCRIPTION OF THE DRAWINGS

For detailed understanding of the present invention, reference should be made to the following detailed description of the preferred embodiment, taken in conjunction with the accompanying drawings, in which like elements have been given like numerals, wherein.

DETAILED DESCRIPTION OF THE INVENTION

As is known, a given well may be divided into a plurality of separate zones which are required to isolate specific areas of a well for purposes including, but not limited to, producing selected fluids, preventing blowouts, and preventing water intake.

Figure 1:
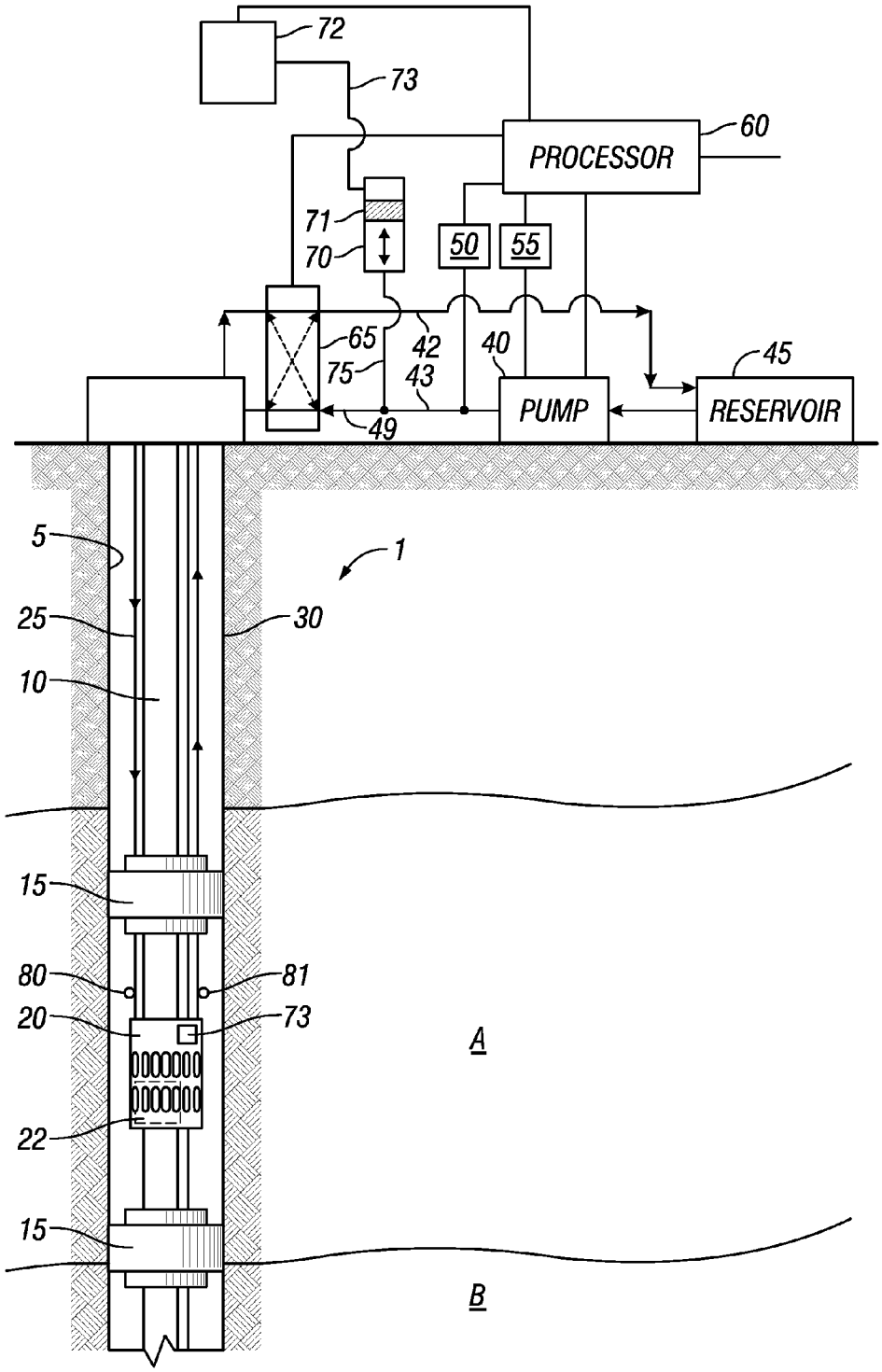
FIG. 1 is a schematic of a production well flow control system according to one embodiment of the present invention.

With reference to FIG. 1, well 1 includes two exemplary zones, namely zone A and zone B, where the zones are separated by an impermeable barrier. Each of zones A and B have been completed in a known manner. FIG. 1 shows the completion of zone A using packers 15 and sliding sleeve valve 20 supported on tubing string 10 in wellbore 5. The packers 15 seal off the annulus between the wellbore and a flow control device, such as sliding sleeve valve 20, thereby constraining formation fluid to flow only through open sliding sleeve valve 20. Alternatively, the flow control device may be any flow control device having at least one moveable element for controlling flow, including, but not limited to, a downhole choke and a downhole safety valve. As is known in the art, a common sliding sleeve valve employs an outer housing with slots, also called openings, and an inner spool with slots. The slots are alignable and misalignable with axial movement of the inner spool relative to the outer housing. Such devices are commercially available. Tubing string 10 is connected at the surface to wellhead 35.

In one embodiment, sliding sleeve valve 20 is controlled from the surface by two hydraulic control lines, opening line 25 and closing line 30, that operate a balanced, dual acting, hydraulic piston (not shown) in the sliding sleeve 20. The hydraulic piston shifts a moveable element, such as inner spool 22, also called a sleeve, to align or misalign flow slots, or openings, allowing formation fluid to flow through sliding sleeve valve 20. Multiple configurations of the moveable element are known in the art, and are not discussed in detail herein. Such a device is commercially available as HCM Hydraulic Sliding Sleeve from Baker Oil Tools, Houston, Texas. In operation, line 25 is pressurized to open the sliding sleeve valve 20, and line 30 is pressurized to close the sliding sleeve valve 20. During a pressurization of either line 25 or 30, the opposite line may be controllably vented by valve manifold 65 to the surface reservoir tank 45. The line 25 and 30 are connected to pump 40 and the return reservoir 45 through valve manifold 65 which is controlled by processor 60. The pump 40 takes hydraulic fluid from reservoir 45 and supplies it under pressure to line 41. Pressure sensor 50 monitors the pressure in pump discharge line 41 and provides a signal to processor 60 related to the detected pressure. The cycle rate or speed of pump 40 is monitored by pump cycle sensor 55 which sends an electrical signal to processor 60 related to the number pump cycles. The signals from sensors 55 and 50 may be any suitable type of signal, including, but not limited to, optical, electrical, pneumatic, and acoustic. By its design, a positive displacement pump discharges a determinable fluid volume for each pump cycle. By determining the number of pump cycles, the volume of fluid pumped can be determined and tracked. Valve manifold 65 acts to direct the pump output flow to the appropriate hydraulic line 25 or 30 to move spool 22 in valve 20 in an opening or closing direction, respectively, as directed by processor 60. Processor 60 contains suitable interface circuits and processors, acting under programmed instructions, to provide power to and receive output signals from pressure sensor 50 and pump cycle sensor 55; to interface with and to control the actuation of manifold 65 and the cycle rate of pump 40; and to analyze the signals from the pump cycle sensor 55 and the pressure sensor 50, 80, 81, and to issue commands to the pump 40 and the manifold 65 to control the position of the spool 22 in the sliding sleeve valve 20 between an open position and a closed position. The processor provides additional functions as described below.

Figure 2:
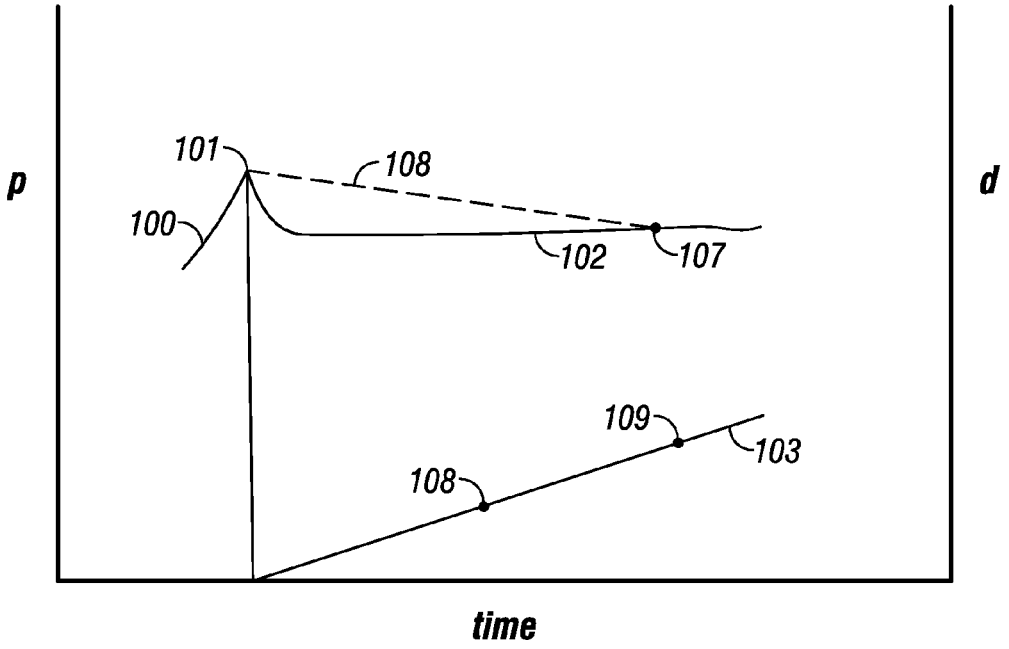
FIG. 2 is a graph showing continued motion of a moveable element in a flow control device due to the effects of static and dynamic friction; and, FIG. 3 is a schematic of pulsed hydraulic pressure in relation to the pressure required to overcome static and dynamic friction and the related movement of a moveable element in a flow control device.

In operation, sliding sleeve valve 20 is commonly operated so that the valve openings are placed in a fully open or fully closed condition. As previously noted, however, it is desirable to be able to proportionally actuate such a device to provide intermediate flow conditions that can be used to choke the flow of the reservoir fluid. Ideally, the pump could be operated to supply a known volume of fluid which would move spool 22 a determinable distance. However, the effects of static and dynamic friction associated with movable elements in the flow control device, such as the spool 22, when combined with the fluid storage capacity of hydraulic lines 25 and 30 can cause significant overshoot in positioning of spool 22. These effects can be seen in FIG. 2, which shows the movement 103 of spool 22 as fluid is pumped to move spool 22. Pump pressure builds up along curve 100. In one embodiment, any pulsations caused by pump 40 are damped out by transmission through the supply line. Pressure is built up to pressure 101 to overcome the static friction of seals (not shown) in sliding sleeve valve 20. In an ideal hydraulic system, once the spool 22 begins to move, the supply line pressure reduces to line 102 and additional fluid can be supplied at the lower pressure to move spool 22 to a desired position 108. However, the entire hydraulic supply line 25, 30 is pressured to the higher pressure 101, and expansion of supply line 25, 30 results in a significant volume of fluid at pressure 101. Instead of the fluid pressure being at level 102, it gradually is reduced along line 107, forcing spool 22 to position 109, and overshooting the desired position 108.

Figure 3:
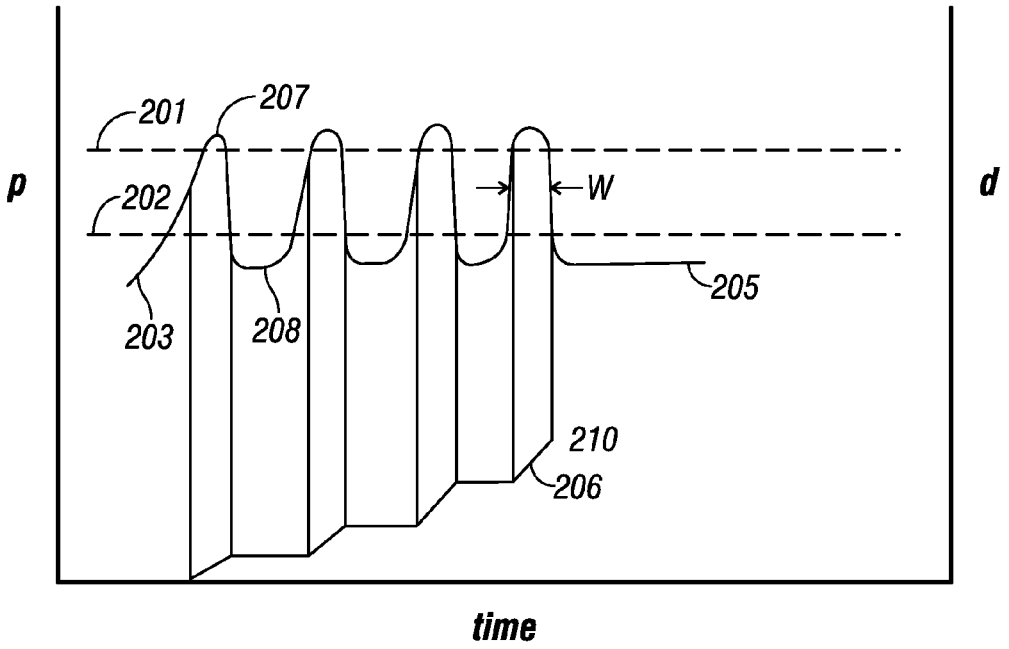

To reduce the overshoot issue, see FIG. 3, the present invention in one embodiment provides pressure pulses 203 that move spool 22 in incremental steps to the desired position. By using pulses 203, the effects of supply line expansion are significantly reduced. Each pulse 203 is generated such that pulse peak pressure 207 exceeds the pressure 201 needed to overcome the static friction force resisting motion of spool 22, and the pulse minimum pressure 208 is less than the pressure 202 required to overcome the force required to overcome the dynamic friction force resisting motion. In one embodiment, pressure pulses 203 are superimposed on a base pressure 205. The motion 206 of spool 22 is essentially a stair step motion to reach the desired position 210. While the spool 22 has been discussed, it should be understood that the spool 22 in only one illustrative movable element. Other movable elements and their associated static and dynamic frictions can also be utilized in the above-described manner.

As shown in FIG. 1, in one embodiment, a pressure source 70, which may be a hydraulic cylinder, is hydraulically coupled to line 49 via line 75. Piston 71 is actuated by a hydraulic system 72 through line 73 that moves piston 71 in a predetermined manner to impress pulses 203 on line 41. Such pulses are transmitted down supply lines 25, 30 and cause incremental motion of spool 22. Hydraulic system 72 may be controlled by processor 60 to alter maximum and minimum pulse pressure and pulse width W, also called pulse duration, to provide additional control of the incremental motion of spool 22. Alternatively, pump 40 may be a positive displacement pump having sufficient capabilities to generate pulses 203.

In one embodiment, the effects of the compliant supply lines 25, 30 are accounted for by comparing signals form pressure sensor 50, at the surface, to signals from pressure sensors 80 and 81, located at the downhole location on supply lines 25 and 30, respectively. Signals from sensors 80 and 81 are transmitted along signal lines (not shown) to processor 60. The comparisons of such signals can be used to determine a transfer function F that relates the transmitted pressure pulse to the received pulse. Transfer function F may be programmed into processor 60 to control one or more characteristics of the generated pressure pulse, such as for example, pulse magnitude and pulse duration, such that the received pressure pulse is of a selected magnitude and duration to accurately position spool 22 at the desired position. As used herein, pulse magnitude is the difference between the maximum pulse pressure 207 and the minimum pulse pressure 208. As used herein, pulse duration is the time in which the pressure pulse is able to actually move spool 22.

In another embodiment, position sensor 83 is disposed in sliding sleeve valve 20 to determine the position of spool 22 within sliding sleeve valve 20. Here, transfer function F' may be determined by comparing the generated pulse to the actual motion of spool 22. Position sensor 83 may be any suitable position sensing technique, such as, for example, the position sensing system described in U.S. patent application Ser. No. 10/289,714, filed on Nov. 7, 2002, and assigned to the assignee of the present application, and which is incorporated herein by reference for all purposes.

While the systems and methods are described above in reference to production wells, one skilled in the art will realize that the system and methods as described herein are equally applicable to the control of flow in injection wells. In addition, one skilled in the art will realize that the system and methods as described herein are equally applicable to land and seafloor wellhead locations.

The foregoing description is directed to particular embodiments of the present invention for the purpose of illustration and explanation. It will be apparent, however, to one skilled in the art that many modifications and changes to the embodiment set forth above are possible. It is intended that the following claims be interpreted to embrace all such modifications and changes.

What is claimed is:

1. A system for controlling flow of fluid in a wellbore, comprising:

a flow control device positioned in the wellbore, said flow control device having a piston operably coupled to a movable element controlling a fluid flow in the wellbore, the movable element being incrementally displaced between a start position and a stop position by a plurality of pressure pulses applied to the piston;

a fluid line hydraulically coupled to the flow control device;

a pump configured to supply hydraulic fluid at a base pressure to the flow control device;

a first line connected at the surface to the pump, wherein the first line conveys the hydraulic fluid from the pump to the fluid line;

a surface hydraulic source configured to transmit the applied pressure pulses to the flow control device, the hydraulic source being configured to alter a pressure and duration of the applied pressure pulses; and a second line connected at the surface to the surface hydraulic source, wherein the second line conveys the applied pressure pulses from the surface hydraulic source to the fluid line.

2. The system of claim 1 wherein a maximum pressure of the applied pressure pulses downhole overcomes a static friction force associated with the moveable element, and wherein a minimum pressure of the applied pressure pulses downhole cannot overcome a dynamic friction force associated with the moveable element.

3. The system of claim 2 further comprising a processor acting according to programmed instructions, the processor controlling the hydraulic source to control the pressure and the duration of the pressure pulses applied to the movable element.

4. The system of claim 3, wherein the processor uses at least one measured parameter of interest of the applied pressure pulses as transmitted by the hydraulic source and at least one measured parameter of interest of the applied pressure pulses as received at the movable element to control said hydraulic source.

5. The system of claim 3, wherein the processor uses a measured position of the movable element and the at least one measured parameter of interest of the applied pressure pulses as transmitted by the hydraulic source to control said hydraulic source.

6. The system of claim 1 wherein the duration of the applied pressure pulse is the time during which the movable element moves.

7. The system of claim 1, further comprising a processor including instructions for controlling the hydraulic source using at least pressure data and pump cycle data.

8. The system of claim 1 wherein the piston is configured to shift the moveable element.

9. A method for controlling flow of fluid in a wellbore, comprising:

positioning a flow control device at a downhole location in the wellbore, the flow control device having a piston operably coupled to a movable element controlling a fluid flow in the wellbore;

incrementally moving the movable element between a start position and a stop position by applying pressure pulses having a controlled magnitude and duration to the piston;

pumping a hydraulic fluid at a base pressure to the flow control device using a pump and a first line connected at the surface to the pump; and generating the applied pressure pulses using a surface hydraulic source and a second line connected at the surface to the surface hydraulic source; and transmitting the applied pressure pulses via a line connected to the flow control device, wherein the first line conveys the hydraulic fluid from the pump to the fluid line and the second line conveys the applied pressure pulses from the surface hydraulic source to the fluid line.

10. The method of claim 9, wherein a maximum pressure of the applied pressure pulses downhole overcomes a static friction force associated with the moveable element, and wherein a minimum pressure of the applied pressure pulses downhole cannot overcome a dynamic friction force associated with the moveable element.

11. The method of claim 9 further comprising:

controlling the hydraulic source with a processor to control at least one controlled characteristic of the transmitted pressure pulses.

12. The method of claim 11 further comprising:

measuring at least one parameter of interest of the applied pressure pulses as transmitted by the hydraulic source; measuring at least one parameter of interest of the applied pressure pulses as received at the movable element; and controlling said hydraulic source based on the measured parameters of interest.

13. The method of claim 11 further comprising:

measuring a position of the movable element; measuring at least one parameter of interest of the applied pressure pulse as transmitted by the hydraulic source; and controlling said hydraulic source based on the at least one measured parameters of interest.

14. The method of claim 9 further comprising: supplying fluid to the flow control device via the line, coupling the hydraulic source to the line to impress the transmitted pressure pulses on the line, and controlling the hydraulic source using at least pressure data and pump cycle data.

15. A system for controlling flow of fluid in a wellbore, comprising:

a flow control device positioned in the wellbore, said flow control device having a piston operably coupled to movable element controlling a fluid flow in the wellbore via a line;

a pump configured to supply hydraulic fluid at a base pressure to the flow control device into the line via a first surface line;

a surface hydraulic source hydraulically coupled to the line via a second surface line and configured to apply a plurality of pressure pulses to the piston via the line, the hydraulic source being further configured to control a pulse magnitude and duration of the plurality of pressure pulses, wherein the hydraulic source is separate from the pump, and wherein the movable element is configured to move incrementally in response to the applied plurality of pressure pulses, wherein the first surface line and the second surface line connect to the line at the surface.

16. The system of claim 15 further comprising a processor acting according to programmed instructions, the processor controlling the hydraulic source to alter the pulse duration of the transmitted pressure pulses, wherein the duration of the applied pressure pulse is the time during which the movable element moves.

17. The system of claim 15 further comprising: a pump supplying fluid to the flow control device via the line and pump cycle sensor coupled to the pump, and a processor controlling the hydraulic source using at least a signal transmitted by the pump cycle sensor.

18. The system of claim 15, wherein the hydraulic source includes a cylinder and a hydraulically actuated piston configured to impress the pressure pulses on the line.

* * * * *